US005427562A

United States Patent [19]

Hwang

[11] Patent Number: 5,427,562

[45] Date of Patent: Jun. 27, 1995

[54] BRASSIERE

[76] Inventor: Ying-Teh Hwang, No. 220, Ruey Feng Street, Kaohsiung, Taiwan

[21] Appl. No.: 121,866

[22] Filed: Sep. 17, 1993

[51] Int. Cl.[6] ..... A44B 11/00; A44B 17/00; A41C 3/02

[52] U.S. Cl. ..... 450/58; 2/73; 24/585; 24/615; 450/71; 450/82

[58] Field of Search ..... 2/67, 73; 450/58, 72, 450/73, 79, 80, 71, 82, 86, 87, 88; 24/616, 194, 682, 580, 581, 584, 585, 615, 614

[56] References Cited

U.S. PATENT DOCUMENTS

| | | | |
|---|---|---|---|
| 1,205,247 | 11/1916 | Munroe | 24/581 |
| 3,200,464 | 8/1965 | Cousins | 24/616 X |
| 3,639,950 | 2/1972 | Lutz et al. | 24/615 |
| 4,679,282 | 7/1987 | Feng | 24/614 |
| 4,908,917 | 3/1990 | Kazle | 24/616 X |
| 4,928,364 | 5/1990 | Ikeda | 24/614 |
| 5,237,728 | 8/1993 | Fudaki | 24/616 X |

*Primary Examiner*—Jeanette E. Chapman
*Attorney, Agent, or Firm*—Bacon & Thomas

[57] ABSTRACT

A brassiere comprising two cups, a back band and an adjuster having a pair of male plug and female socket halves to interconnect the two cups for providing a front adjustment. The socket defines a longitudinal passage and has a side wall formed therein with an opening which is defined by two parallel corrugated inner side walls. The plug includes a plate dimensioned to move freely along the passage in the socket and a central tongue split from an inner end of the plate, resiliently deformable with respect to the plate and terminated with a barb-like head. The barb-like head is engageable with the corrugated inner side walls of the socket so that the plug can be locked at any of a plurality of positions with respect to the socket.

4 Claims, 3 Drawing Sheets

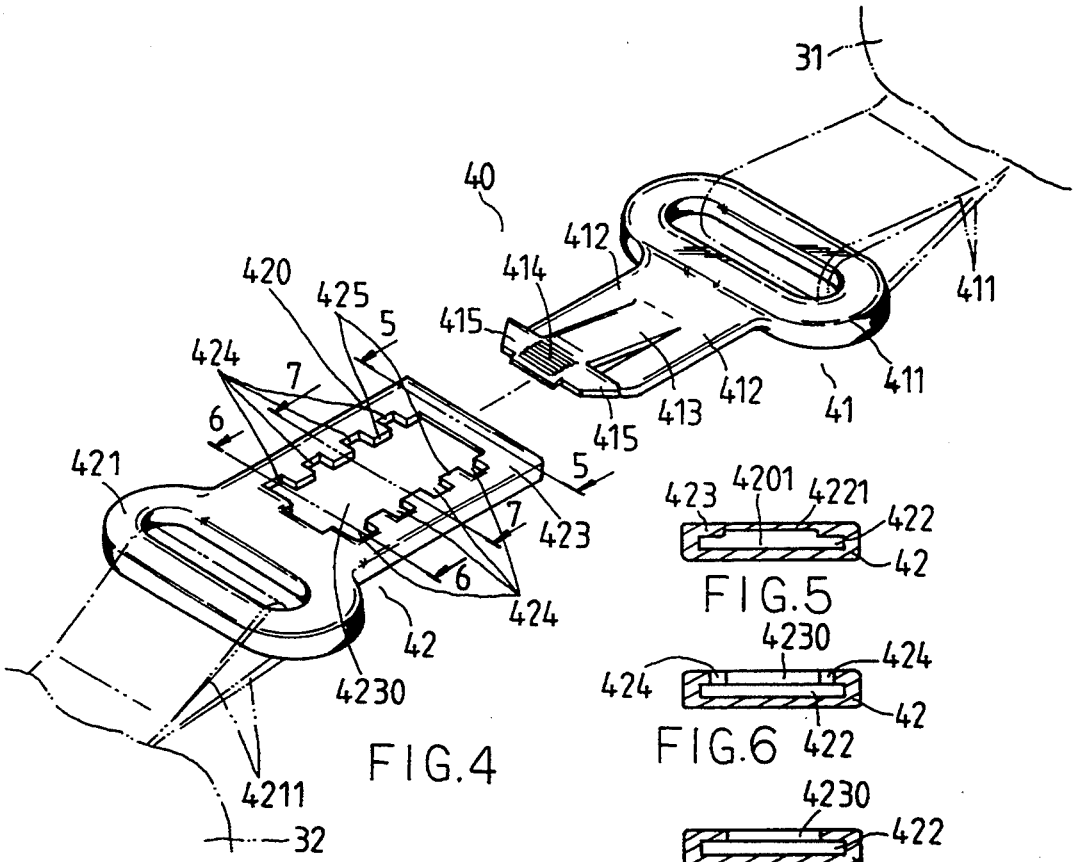
FIG.4
FIG.5
FIG.6
FIG.7
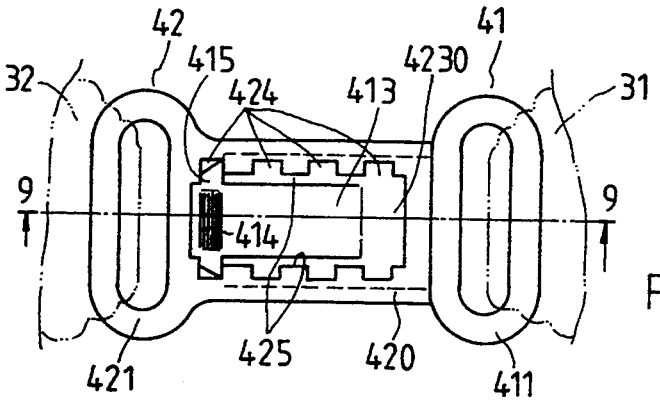
FIG.8
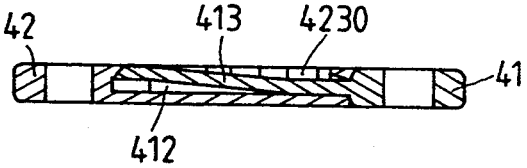
FIG.9

BRASSIERE

BACKGROUND OF THE INVENTION

The present invention relates to the construction of a brassiere, and more particularly to a brassiere with a balance type minute lengthenable adjuster.

In brassiere constructions, a given size may suit a certain woman's bust, whereas her rib cage may be larger or smaller than the standard size. It is customary to provide an adjuster for the back bands of the brassiere, but the said adjustment in the back of the brassiere does not help the conditions with respect to the rib cage area.

Variations of the aforementioned adjustable brassieres have been suggested over the years. FIG. 1 shows a known adjustable brassiere 10 which is provided with two cups 11, 12, two back bands 111, 121 seamed to the cups 11, 12, a pair of hooks 112 attached to the free end of the back band 111 and an end piece 124, which is provided with a plurality of rows of eyes 122, 123 to receive the hooks 112 and provide adjustment, attached to the free end of the back band 121. This know adjustable brassiere is not effective and has drawbacks listed below:

1. It is inconvenient in operation from the standpoint of human structure since the adjuster thereof is located at the back where it cannot be seen when handling;

2. In adjustment operation, one the back band 111 is advanced by replacing the hooks 112 from the row of eyes 122 to 123, and the back band 121 does not move at all. Consequently, the length of tile back bands are adjusted only for one side, and thus not balanced for both sides.

FIG. 2 shows another known brassiere 20 which is provided with two cups 21, 22 and a connector 23 at the vertical center of the brassiere 20. This known brassiere 20 is relatively convenient in operation but has no adjuster for length adjustment when required.

SUMMARY OF THE INVENTION

It is therefore a primary object of the present invention to provide a brassiere with an improved adjuster providing a front adjustment to meet various female individual requirements.

It is another object of the present invention to provide a brassiere with an improved adjuster which is compact in size and easy to operate.

BRIEF DESCRIPTION OF THE DRAWINGS

FIG. 4 is an exploded perspective view showing an adjuster to be used in the brassiere as shown in FIG. 3;

FIG. 5 is a cross-sectional view taken along line 5—5 in FIG. 4;

FIG. 6 is a cross-sectional view taken along line 6—6 in FIG. 4;

FIG. 7 is a cross-sectional view taken along line 7—7 in FIG. 4;

FIG. 8 is an enlarged side view showing the adjuster in a connected condition;

FIG. 9 is a cross-sectional view taken along line 9—9 in FIG. 8.

DETAILED DESCRIPTION OF THE PREFERRED EMBODIMENT

Figure 1:
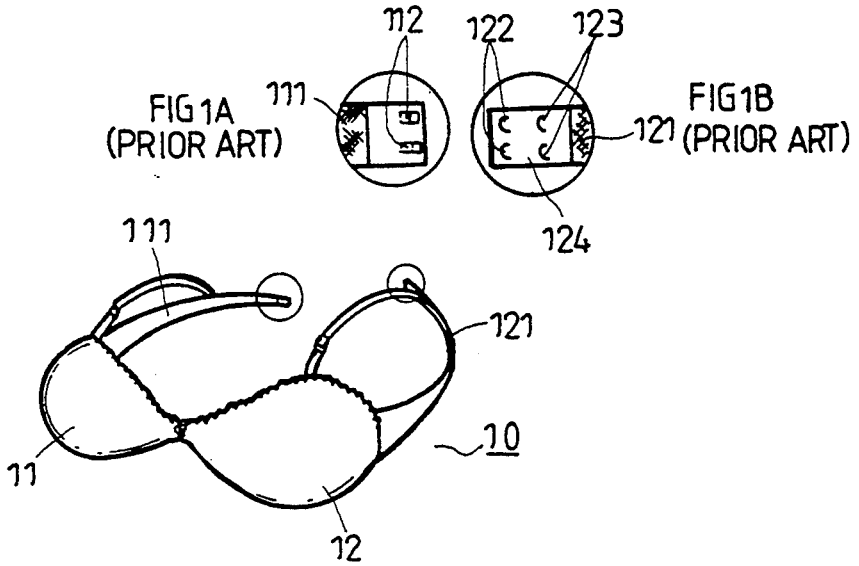
FIG. 1 (PRIOR ART)
FIG. 1 is a perspective view of a first known brassiere having a back adjuster.
Figure 2:
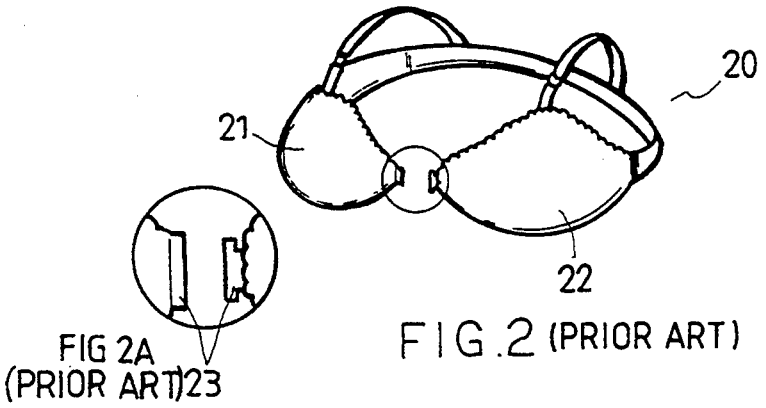
FIG. 2 (PRIOR ART)
FIG. 2 is a perspective view of a second known brassiere having a front connector.
Figure 3:
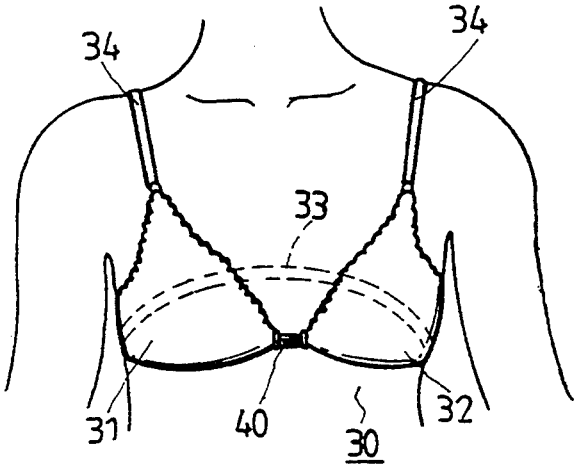
FIG. 3 is a front view of a brassiere according to the present invention which is shown worn by a user.
Figure 10:
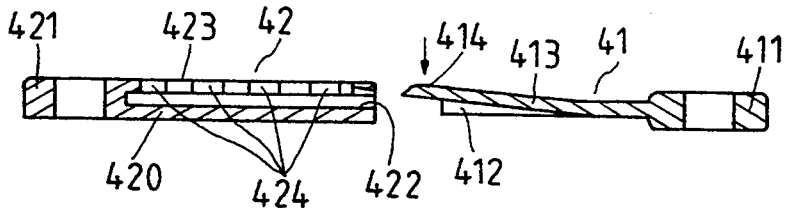
FIGS. 10 to 12 are cross-sectional view of the adjuster in FIG. 9 showing sequential steps in the connecting operation.
Figure 11:
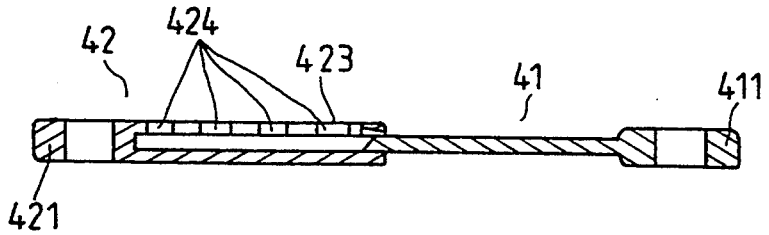
Figure 12:
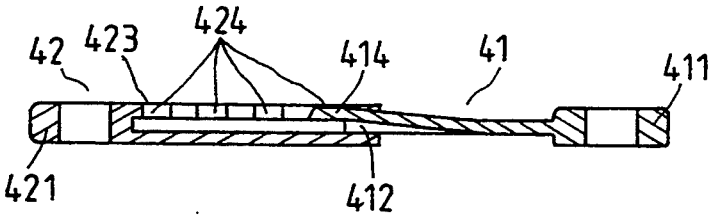

Referring to FIG. 3, a brassiere 30 according to the present invention comprises two cups 31, 32, an adjuster or adjustable connector 40 provided to join the two cups 31, 32 and provide a front adjustment, conventional shoulder straps 34 attached to upper edges of the cups 31, 32 and back band 33 (as shown in dotted-lines) surrounding the back portion of a woman's rib cage area.

Referring to FIG. 4, seamed to inner ends of the cups 31, 32 are two return-bent straps 4111, 4211 which extend through respective openings of ring members 411, 421 at the outer ends of a first half or plug 41 and a second half or socket 42 of connector 40. The first half 41 of the connector 40 includes a plate member 412 with the ring member 411 integrally formed at the rear end thereof and a central tongue 413 split from the front end of the plate member 412 and extending slightly upwardly along an inward direction. The tongue 413 is elastic relative to the plate member 412 and tends to permanently bias towards the position shown in FIG. 4. Front end of the central tongue 413 terminates with a flat end substantially parallel to the plate member 412 and laterally formed with juxtaposed projections or wing members 415 and knurled on top thereof at 414.

The second half 42 includes a receptacle 420 having opposed top 423 and bottom walls and side walls to define a tunnel or passage 422 dimensioned to allow passing therethrough of the plate member 412 together with the tongue 413 of the first half 41 and the ring member 421 integrally formed at the rear end of the receptacle 420. Top wall 423 is perforated to form a slot 4230 of which the width defined by opposed inner side walls 425 is the same as the width of the tongue 413. The inner side walls 425 of the slot 4230 are corrugated to form a plurality of recesses 424 evenly spaced along a longitudinal direction of the top wall 423 of the receptacle 420, as best shown in FIGS. 4 to 7. Top wall 423 in the front end or entrance end portion of the receptacle at 4221, as best shown in FIG. 5, is thinner than the rest of the top wall 423 for permitting the plug-in operation of the first half 41 into the second half 42 and provides a chamber to receive the tongue 413 when the two halves 41, 42 of the connector 40 are in interlocking condition.

Referring to FIGS. 8 to 12, in connecting and adjusting operations, is pressed the tongue 413 is first pressed with a finger tip at its knurled top 414 to a position where the tongue 413 is substantially in alignment with the plate member 412. Then plug the first hall 41 into the second half 42 by inserting the barb-like front end of the tongue 413 into the passage 422 within the receptacle 420. The passage 422 is dimensioned to allow the tongue 413 and the plate member 412 of the first half 41 to move freely back and forth whenever the tongue 413 is retained at the position where the tongue 413 is substantially in alignment with the plate member 412. As described heretofore, the tongue 413 is resiliently deformable and tends to bias slightly upwardly towards the position shown in FIG. 4. The barb-like end of the tongue 413 can be engaged in the corrugated inner side walls 425 or the slot 4230 of the top wall 423 of the receptacle 420 by engaging the wing members 415 in corresponding recesses 424 so that the first half 41 can be locked at any of a plurality of positions with respect to the second half 42 between positions shown in FIG. 8 and FIG. 12.

In release operation, simply press the barb-like end of the tongue 413 with finger tip at the knurled top 414 to disengage the barb-like end of the tongue 413 from the corrugated inner side walls 425 of the slot 4230 so that the wing members 415 become withdrawn from the corresponding recesses 424, thus permitting the plate member 412 of the first half 41 and the tongue 413 to move freely along the passage 422 so as to release the first half 41 from the second half 42.

Unlike the known brassieres, the brassiere of the present invention provides an improved adjuster for working a front adjustment which is compact in size, easy in operation and can be selectively manipulated to tighten or loosen the back band thereof in a balanced way to meet the wearer's individual requirements.

What is claimed is:

1. An adjustable connector for a brassiere of the type having two cups and a back band seamed to the cups, which connector comprises:

a) a socket element including front and rear ends and a plug element including first and rear ends;

b) the socket element having a longitudinal passage partially formed by a major sidewall having an opening therein, the opening being formed by a pair of opposed longitudinal corrugated sidewalls defining plural pairs of inwardly directed corresponding recesses; and c) the plug element having a plate member with a distal end, the plate member dimensioned for insertion within the longitudinal passage of the socket element, the plate member having a central resilient tongue having an end displace from the distal end of the plate member, the central tongue including pair of laterally outwardly extending projections configured for engagement within one pair of the plural pairs of corresponding recesses to permit longitudinal adjustment of the plug element relative to the socket element.

2. The adjustable connector of claim 1 wherein the end of the central tongue further comprises a knurled surface between the pair of projections.

3. The adjustable connector of claim 1 wherein the rear end of the socket element and the rear end of the plug element each further comprises a ring member integrally formed therewith for connection to straps of a brassiere.

4. The adjustable connector of claim 1 wherein the deformable central tongue extends upwardly in a direction extending from the rear end towards the front end of the plug element.

* * * * *